US006471325B2

(12) United States Patent
Abe

(10) Patent No.: US 6,471,325 B2
(45) Date of Patent: Oct. 29, 2002

(54) IMAGE PRINTING SYSTEM AND PRINTING METHOD OF THE SAME

(75) Inventor: Koichi Abe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/842,121

(22) Filed: Apr. 26, 2001

(65) Prior Publication Data

US 2002/0001010 A1 Jan. 3, 2002

(30) Foreign Application Priority Data

Apr. 28, 2000 (JP) ..... 2000-131627

(51) Int. Cl.[7] ..... B41J 29/393; B41J 29/38; B41J 2/165

(52) U.S. Cl. ..... 347/19; 347/14; 347/23

(58) Field of Search ..... 347/2, 3, 19, 49, 347/14, 23, 12; 358/296

(56) References Cited

U.S. PATENT DOCUMENTS 5,363,134 A * 11/1994 Barbehenn et al. ..... 347/49
6,091,514 A * 7/2000 Hasegawa et al. ..... 358/269

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

The type of cartridge attached to a carriage of a scanner printer is detected by an ID stored in the cartridge. A PC starts a predetermined operation after confirming that the scanner cartridge is attached, when starting image reading, and that the ink cartridge is attached, when starting image printing, on the basis of the detected type of cartridge. This allows a user to confirm that a predetermined head is attached, without any cumbersome operation.

16 Claims, 10 Drawing Sheets

FIG. 5

| | READING SETTING | | PRINTING SETTING | | | |
|---|---|---|---|---|---|---|
| COPY PURPOSE | READING METHOD | READING RESOLUTION (dpi) | PRINTING METHOD | PRINTING RESOLUTION (dpi) | PRINTING MEDIUM | PRINTING QUALITY |
| DPT (COLOR) | COLOR | 180×180 | COLOR | 360×360 | PLAIN PAPER | STANDARD |
| DPT (MONOCHROMATIC) | GRAY SCALE | 180×180 | GRAY SCALE | 360×360 | PLAIN PAPER | STANDARD |
| PHOTOGRAPH | COLOR | 360×360 | COLOR | 360×360 | HIGH-QUALITY PAPER | HIGH QUALITY |
| FAX | BLACK-AND-WHITE | 200×200 | MONOCHROMATIC | 360×360 | PLAIN PAPER | STANDARD |
| OCR | BLACK-AND-WHITE | 360×360 | MONOCHROMATIC | 360×360 | PLAIN PAPER | STANDARD |
| TEXT | BLACK-AND-WHITE | 180×180 | MONOCHROMATIC | 360×360 | PLAIN PAPER | STANDARD |

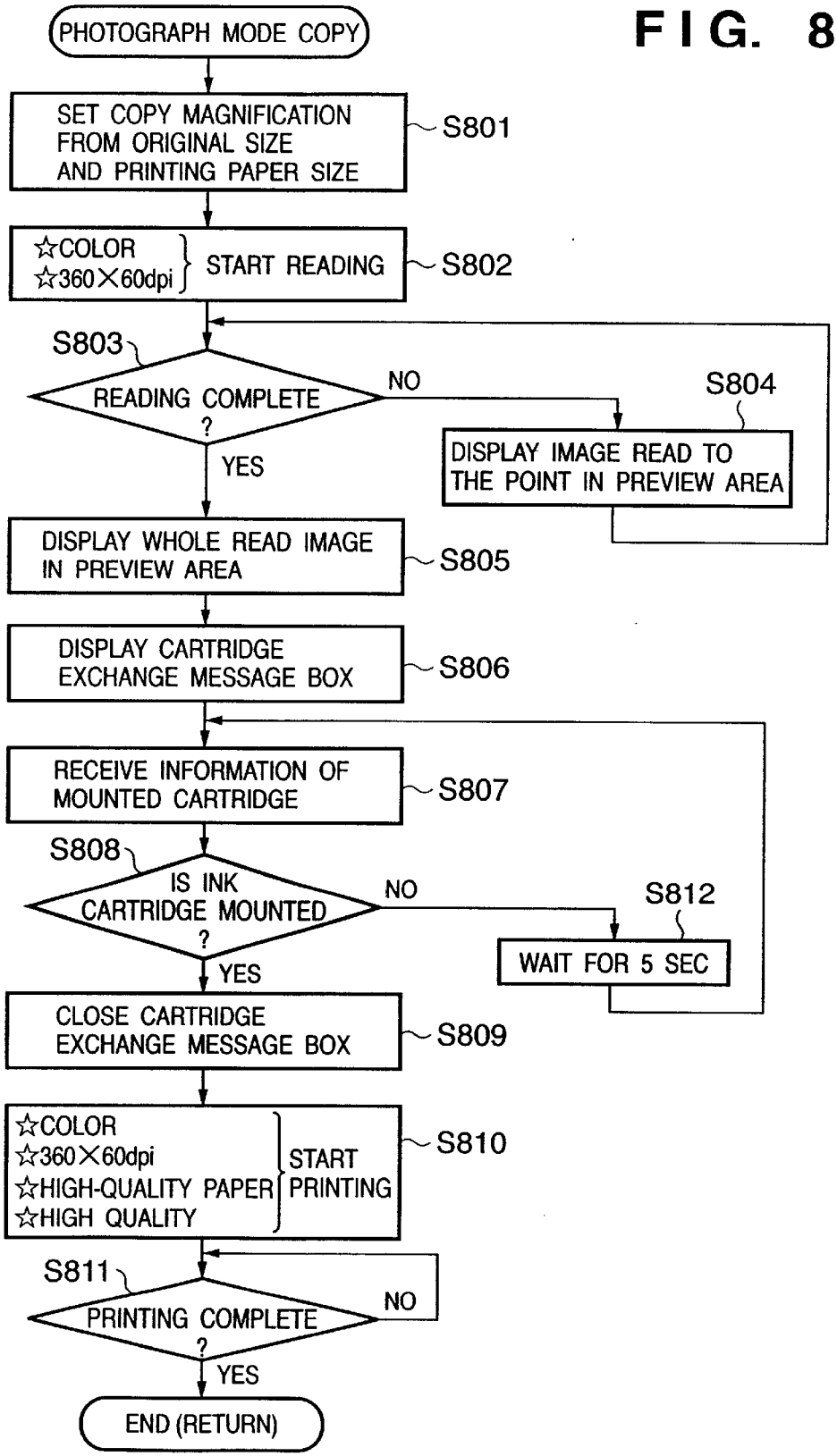
FIG. 8
PHOTOGRAPH MODE COPY
SET COPY MAGNIFICATION FROM ORIGINAL SIZE AND PRINTING PAPER SIZE
S801
☆COLOR
☆360×60dpi
START READING
S802
S803
READING COMPLETE ?
NO
S804
DISPLAY IMAGE READ TO THE POINT IN PREVIEW AREA
YES
DISPLAY WHOLE READ IMAGE IN PREVIEW AREA
S805
DISPLAY CARTRIDGE EXCHANGE MESSAGE BOX
S806
RECEIVE INFORMATION OF MOUNTED CARTRIDGE
S807
S808
IS INK CARTRIDGE MOUNTED ?
NO
S812
WAIT FOR 5 SEC
YES
CLOSE CARTRIDGE EXCHANGE MESSAGE BOX
S809
☆COLOR
☆360×60dpi
☆HIGH-QUALITY PAPER
☆HIGH QUALITY
START PRINTING
S810
S811
PRINTING COMPLETE ?
NO
YES
END (RETURN)

IMAGE PRINTING SYSTEM AND PRINTING METHOD OF THE SAME

FIELD OF THE INVENTION

The present invention relates to an image printing system which comprises an apparatus having an image data reading function and image data printing function and an information processor connected to the apparatus, and which prints read image data, and a printing method of the same.

BACKGROUND OF THE INVENTION

A copy application is conventionally available which uses a scanner apparatus having an image reading function and a printer apparatus having an image data printing function, as peripheral devices of a personal computer, and which has a copy function of reading an original set in the scanner apparatus and causing the printer apparatus to print the read data.

The operation on the user interface of such a copy application is so designed that copying can be performed by simply setting the number of copies and pressing a copy button.

On the other hand, as a variation of an inkjet printer apparatus in which an ink cartridge is mounted on a carriage, an apparatus (scanner printer apparatus) capable of realizing a reading function of reading an image of an original by mounting a scanner cartridge instead of an ink cartridge has been proposed. A copy application for this apparatus also has been proposed. Note that a cartridge will also be simply referred to as a "unit" hereinafter.

When, however, a reading operation and a printing operation are to be successively performed by using the copy application for the scanner printer apparatus described above, a scanner cartridge must be removed and replaced with an ink cartridge after the reading operation. For this purpose, after reading is completed, a cartridge exchange message box 1001 as shown in FIG. 10 is displayed. A printing operation is started when a user clicks an OK button 1002 in this message box 1001 after exchanging the cartridges following the procedure indicated in the message box 1001.

To copy, therefore, at least the following operations by the user are necessary:

(1) Attach the scanner cartridge (if the scanner cartridge is already attached, this operation is unnecessary)

(2) Set an original (3) Click a copy button (4) Set a printing sheet (after reading is completed)

(5) Remove the scanner cartridge and replace it with the ink cartridge following the procedure in the cartridge exchange message box (FIG. 10)

(6) Click the OK button 1002 in the cartridge exchange message box (FIG. 10)

That is, the unit mounted on the carriage must be replaced after an image of an original is read and before the read image is printed. Therefore, the processing is temporarily stopped after the reading operation is completed. After the user exchanges the units and performs an operation indicating the completion of exchange, the processing is resumed to start the printing operation.

As described above, to make even one copy it is necessary to perform not only operation (5) of exchanging cartridges but also operation (6) of clicking the OK button 1002. This makes the operations very troublesome for the user.

SUMMARY OF THE INVENTION

The present invention has been made to solve the above problem, and has as its object to provide an image printing system and printing method of the same capable of reading an original image and printing the read image without any cumbersome operations by a user.

To achieve the above object, according to one aspect of the present invention, there is provided an image printing system which comprises an image forming apparatus capable of attaching a printhead for printing or a reading head for reading, and an information processor connected to the image forming apparatus, and which prints a read image, comprising detecting means for detecting the type of head attached to the image forming apparatus, and checking means for checking the type of head detected by the detecting means, wherein the information processor starts a predetermined operation after confirming that the reading head is attached, when starting image reading, and that the printhead is attached, when starting image printing, on the basis of the type of head.

According to another aspect of the present invention, there is provided a printing method of an image printing system which comprises an image forming apparatus capable of attaching a printhead for printing or a reading head for reading, and an information processor connected to the image forming apparatus, and which prints a read image, comprising the detecting step of detecting the type of head attached to the image forming apparatus, and the checking step of checking the type of head detected in the detecting step, wherein the information processor starts a predetermined operation after confirming that the reading head is attached, when starting image reading, and that the printhead is attached, when starting image printing, on the basis of the type of head.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 5 is a view showing reading settings and printing settings assigned to buttons 411 to 416 representing copy purposes;

FIG. 8 is a flow chart showing the event processing in step S603 of FIG. 6;

DETAILED DESCRIPTION OF THE PREFERRED EMBODIMENT

A preferred embodiment of the present invention will now be described in detail in accordance with the accompanying drawings.

Figure 1:
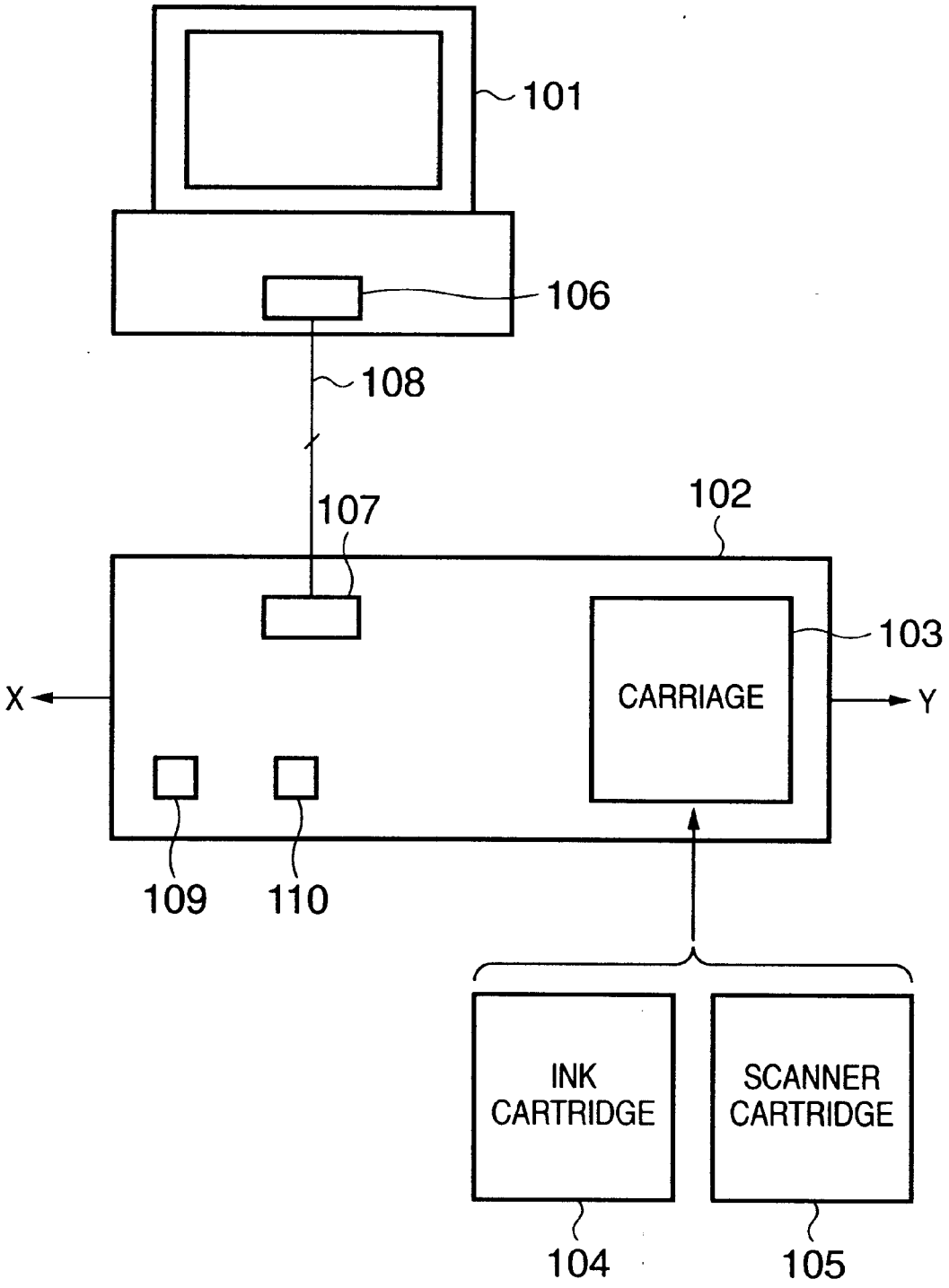
FIG. 1 is a block diagram showing the arrangement of a copy system according to an embodiment.

FIG. 1 is a block diagram showing the arrangement of a system according to this embodiment. In FIG. 1, reference numeral 101 denotes a personal computer (to be abbreviated as a "PC" hereinafter) which is integrated with a display in this embodiment. An OS (Operating System) which is software for managing the whole computer is Windows (R) 95 or 98 of Microsoft Corp. A printer 102 is an inkjet printer to which an ink cartridge integrated with a head can be attached. An ink cartridge 104 or a scanner cartridge 105 is mounted on a carriage 103. That is, this carriage 103 can selectively mount the ink cartridge 104 for printing and the scanner cartridge 105 as a reading means for reading. In this embodiment, the ink cartridge 104 is a printhead cartridge integrating a printhead for discharging ink and an ink tank for containing ink. Accordingly, this ink cartridge 104 will also be referred to as a printhead or a printing means hereinafter.

This printer can be given a function as a scanner by attaching the scanner cartridge 105, instead of the ink cartridge 104, to the carriage 103 (the printer 102 will be referred to as a scanner printer or an electronic apparatus hereinafter). Reference numerals 106 and 107 denote bidirectional parallel interface ports. Bidirectional parallel communication is performed between the PC 101 and the scanner printer 102 via a parallel interface cable 108.

A cartridge exchange button 109 is pressed when the ink cartridge 104 or the scanner cartridge 105 is to be replaced. When this button is pressed, the carriage 105 moves to a cartridge exchange position (not shown), and a user can freely exchange the cartridges in this state. A sensor 110 senses a printing sheet or an original. More specifically, this sensor 110 senses the presence/absence of a printing sheet in printer mode in which the ink cartridge 104 is mounted on the carriage 103, and senses the presence/absence of an original in scanner mode in which the scanner cartridge 105 is mounted on the carriage 103 (sheets pass through a common path (to be referred to as a "paper path" hereinafter)).

The carriage 103 moves in the X–Y direction in FIG. 1 to print or read. Assume that the ink cartridge 104 is attached to the carriage 103 in this embodiment.

Figure 2:
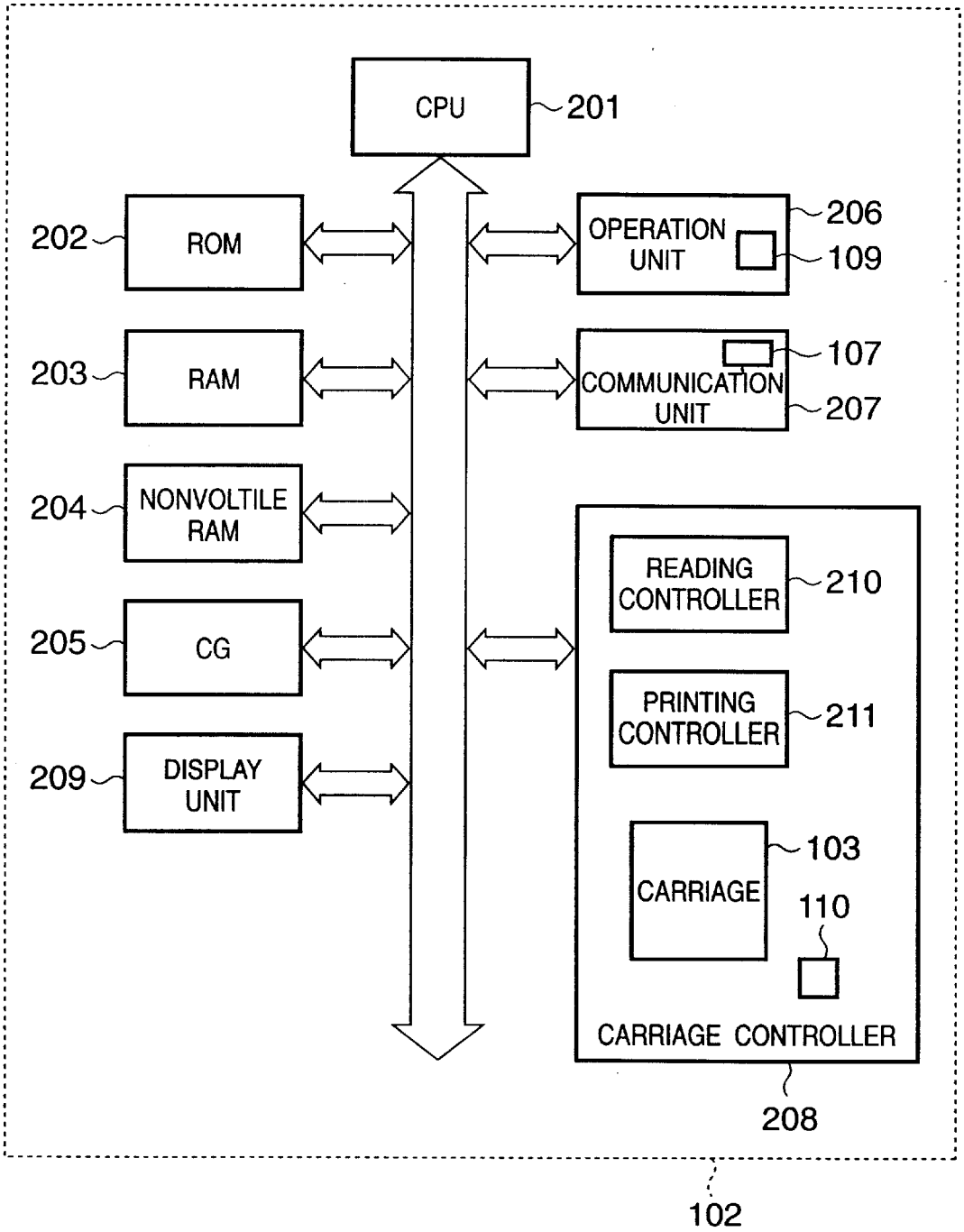
FIG. 2 is a block diagram showing details of the arrangement of a scanner printer 102.

FIG. 2 is a block diagram showing details of the arrangement of this scanner printer 102. Referring to FIG. 2, a CPU 201 such as a microprocessor controls the whole apparatus in accordance with a program to be described later. A ROM 202 stores the program, control data, and the like of the CPU 201. A RAM 203 is a memory in which a work area used by the CPU 201 to execute processing, various tables, and the like are defined. This RAM 203 also stores print data transmitted from the PC 101 or image data which is read via the scanner cartridge 105 under the control of a reading controller to be described later and is supplied from a carriage controller.

A nonvolatile RAM 204 reliably stores user data and other most significant data (e.g., residual ink amount data of the ink cartridge 104) to be saved, even when the power supply (a power supply unit is omitted in this embodiment) of the scanner printer 102 is shut down. A character generator (CG) 205 is a ROM storing characters such as the JIS code and the ASCII code and various fonts. This CG 205 outputs 1- or 2-byte character data corresponding to a predetermined code where necessary under the control of the CPU 201.

An operation unit 206 includes, e.g., a power switch and reset switch (neither is shown) and the cartridge exchange button 109 shown in FIG. 1, and can be freely operated by a user. A communication unit 207 includes the port 107 shown in FIG. 1 and controls bidirectional parallel communication between the PC 101 and the scanner printer 102 in accordance with the IEEE P1284 as a standard of Standard Signaling Method for a Bi-directional Parallel Peripheral Interface for Personal Computers.

A carriage controller 208 controls the operation of a reading controller or printing controller to be described later in accordance with a cartridge attached to the carriage 103. More specifically, the carriage controller 208 checks whether the cartridge is the ink cartridge 104 or the scanner cartridge 105 by detecting an ID stored in the cartridge. If the ink cartridge 104 is mounted, the printing controller to be described later controls a printing operation (printer mode). If the scanner cartridge 105 is mounted, the reading controller to be described later controls a reading operation (scanner mode). A display unit 209 comprises an LED, buzzer, and the like (none is shown), and informs the user of the status of the scanner printer 102 during printing or reading.

A reading controller 210 comprises a DMA controller, image processing IC, CMOS logic IC, and the like (none is shown). Under the control of the CPU 201, this reading controller 210 forms multi-valued data or binary data from data read by the scanner cartridge 105 and sequentially supplies the data to the RAM 203. A printing controller 211 comprises a DMA controller, inkjet printing control IC, CMOS logic IC, and the like (none is shown). Under the control of the CPU 201, this printing controller 211 reads out print data stored in the RAM 203 and prints out the data as a hard copy. The carriage controller 208 includes the sensor 110 (shown in FIG. 1) which senses the presence/absence of a printing sheet or an original. In accordance with the state of sensing, the carriage controller 208 controls printing or reading.

In accordance with a control command from a copy application to be described later, the CPU 201 of the scanner printer 102 can discriminate the cartridge mounted on the carriage 103 on the basis of the ID described above, and notify the PC (host) 101 of information of the discrimination result via the communication unit 207. The following three pieces of information can be transmitted:

a) The ink cartridge 104 is attached to the carriage 103 b) The scanner cartridge 105 is attached to the carriage 103 c) No cartridge is attached to the carriage 103

Figure 3:
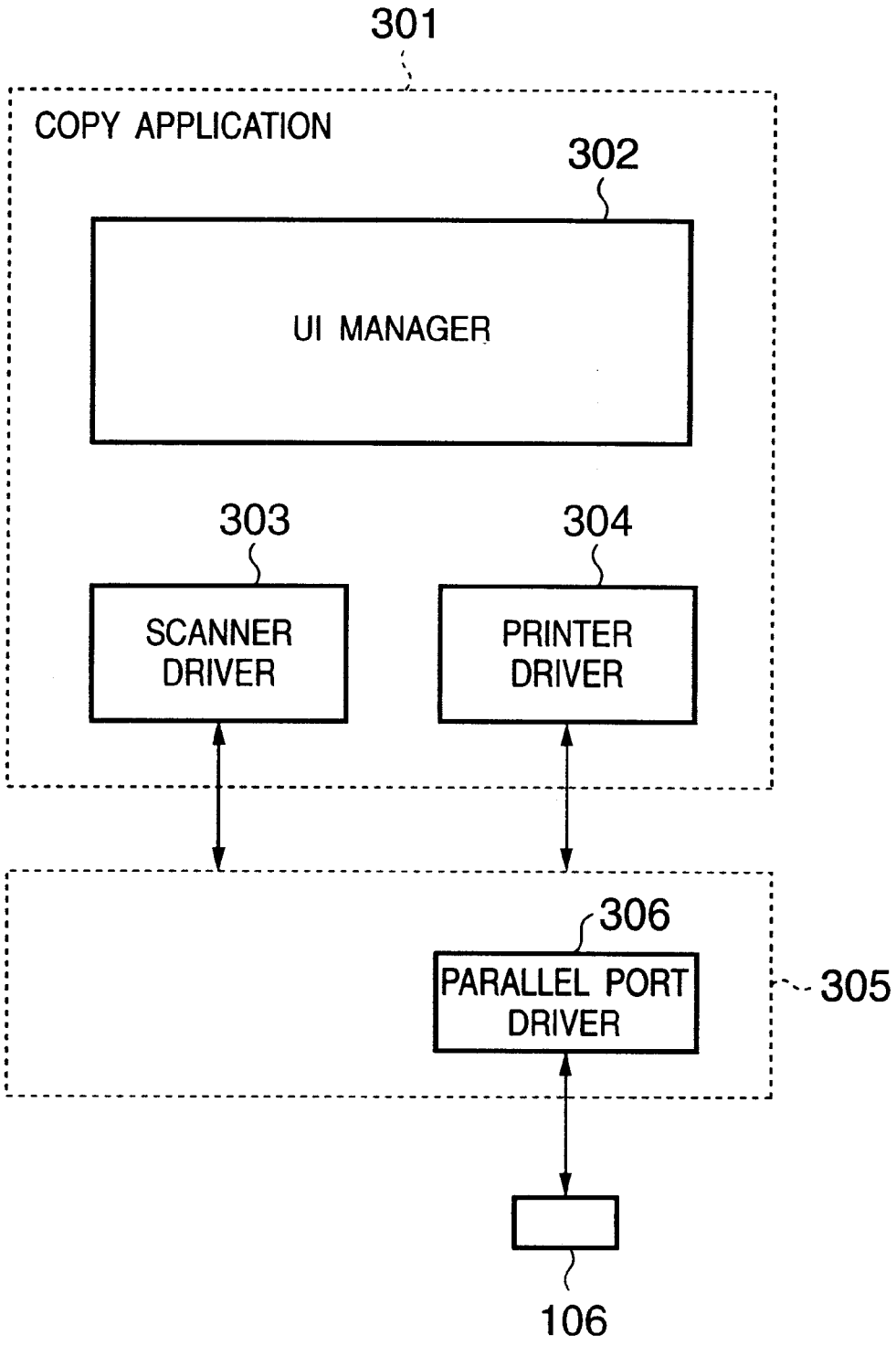
FIG. 3 is a block diagram showing the configuration of a copy application according to the embodiment.

FIG. 3 is a block diagram showing the configuration of the copy application program according to this embodiment. This copy application is activated as an application on the PC 101 by the OS. The arrangement and operation of activating an application are generally known to those skilled in the art, so a detailed description thereof will be omitted.

In this embodiment, a program code of the copy application is supplied to the PC 101 by a storage medium such as a CD-ROM. However, the present invention is not limited to this embodiment. For example, if the PC 101 has a network function, the program code can be supplied by download from a predetermined apparatus (e.g., a server apparatus) on the network to which the PC 101 is connected.

A program of the supplied copy application is prestored in a hard disk drive (not shown) of the PC 101. When the copy application is activated by the OS, the program of this copy application is executed, and the modules shown in FIG. 3 appear on the RAM of the PC 101.

Referring to FIG. 3, a copy application 301 comprises a UI manager, scanner driver, and printer driver to be described in detail below. A scanner driver 303 controls image reading using a scanner function, processing of the read image, and the like. A printer driver 304 controls, e.g., image printing and image processing by using a printer function of the scanner printer 102. The scanner driver 303 and the printer driver 304 are prestored in a storage device such as a hard disk (not shown) in the PC 101. The copy application 301 can control the scanner printer 102 via the scanner driver 303 and the printer driver 304, and has a function of copying an original and printing the copied original by the printer. Settings for copying will be described later.

A UI manager 302 has and controls a user interface (a main dialogue box to be described later). This UI manager 302 is a module for controlling the scanner printer 102 via the scanner driver 303 and the printer driver 304. The UI manager 302 also controls the user interface and the scanner printer 102 on the basis of operation input information from the user and information from the scanner driver 303 and the printer driver 304.

A port driver 305 is a module provided by the OS. This port driver 305 includes a parallel port driver 306 for controlling at least the parallel interface port 106. In accordance with designations by the UI manager 302, the parallel port driver 306 transmits and receives data by controlling the parallel interface port 106.

Figure 4:
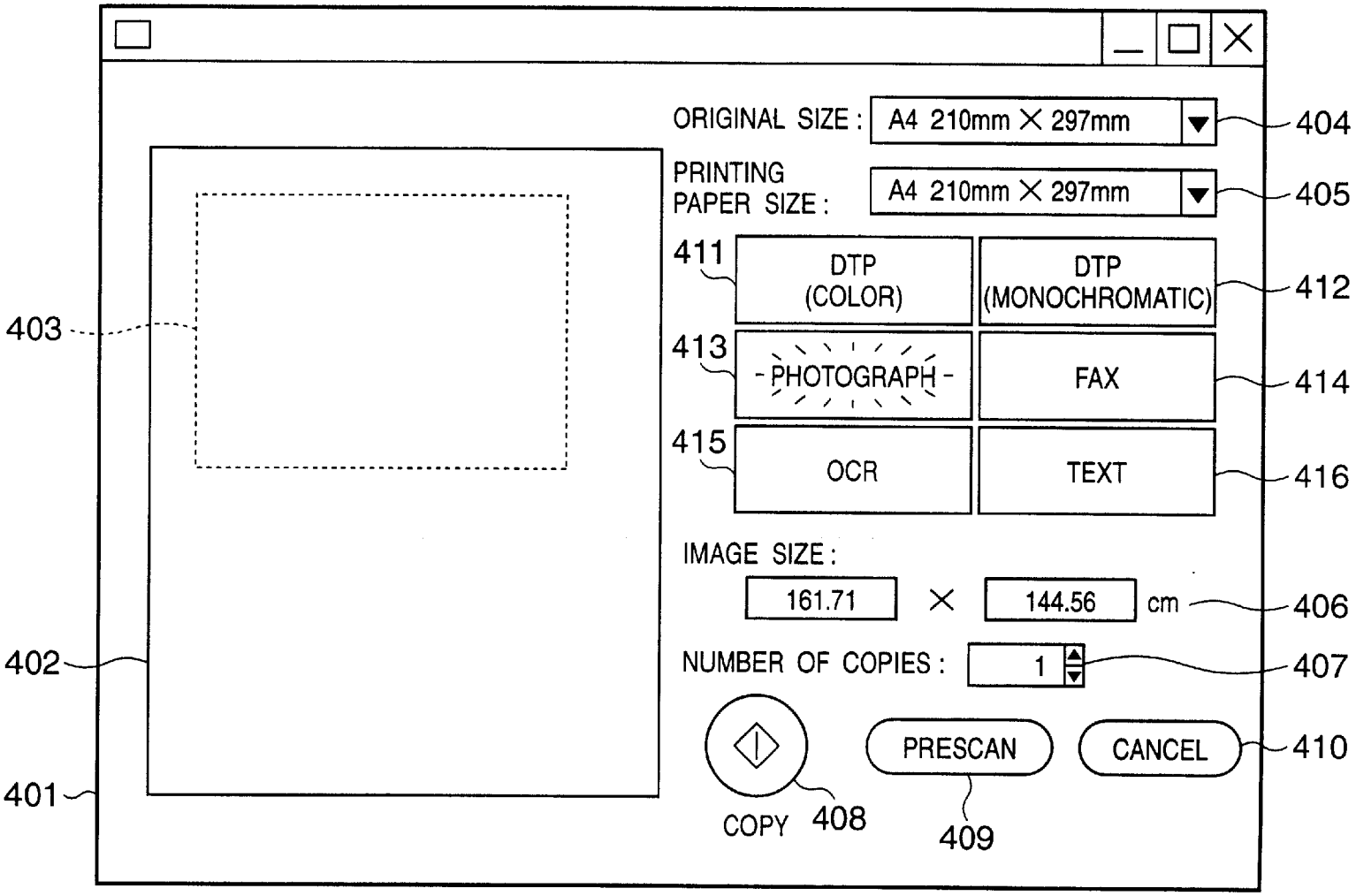
FIG. 4 is a view showing an example of a main dialogue box as a user interface.

FIG. 4 is a view showing an example of the main dialogue box as a user interface. Referring to FIG. 4, a main dialogue box 401 determines various settings and the like of the scanner printer 102 and performs operations, e.g., activates or stops a copying operation, when operated by the user. This main dialogue box 401 is displayed on the display of the PC 101. The user designates (clicks) various buttons on the main dialogue box 401 displayed on the display by using a pointing device such as a mouse, thereby inputting diverse operations. In this embodiment, the main dialogue box 401 includes a preview area 402, a reading range 403, an original size selector 404, a printing paper size selector 405, a DTP (color) button 411, a DTP (monochromatic) button 412, a photograph button 413, a FAX button 414, an OCR button 415, a text button 416, an image size display 406, a copy quantity designating portion 407, a copy button 408, a prescan button 409, and a cancel button 410.

In the preview area 402, a prescanned image or an image read by copying is displayed. The reading range 403 is a range designating tool for setting an arbitrary actual reading range within a readable range. The original size selector 404 has a popup menu and can select an arbitrary original size to be read from postcard (100×148 mm), A5 (148×210 mm), A4 (210×297 mm), A3 (297×420 mm), B5 (182×257 mm), and B4 (257×364 mm). In the example shown in FIG. 4, A4 (210×297 mm) is selected.

The printing paper size selector 405 has a popup menu and can select an arbitrary paper size to be printed from postcard (100×148 mm), A5 (148×210 mm), A4 (210×297 mm), A3 (297×420 mm), B5 (182×257 mm), and B4 (257×364 mm). In the example shown in FIG. 4, A4 (210×297 mm) is selected. The image size display 406 displays horizontal length x vertical length (cm) designated by the reading range 403. The copy quantity designating portion 407 includes a text field and a spin button and can designate an arbitrary number of copies from 1 to 99 for one set of originals.

The copying magnification is determined on the basis of the original size selected by the original size selector 404 and the paper size selected by the printing paper size selector 405. In copying, the copy application 301 enlarges or reduces an image received from the scanner printer 102 on the basis of the determined copying magnification, and transmits the enlarged or reduced image to the scanner printer 102. For example, when "B5" is selected as an original size and "A4" is selected as a paper size, the copying magnification is set to be 115%. Accordingly, the copy application 301 enlarges a received image by 115%.

Reference numerals 411 to 416 denote buttons, one of which is selected (highlighted) when clicked or pressed. When the copy button 408 or the prescan button 413 is clicked (pressed) while one of these buttons 411 and 416 is selected (highlighted), the function of the button is achieved. Referring to FIG. 4, the photograph button 413 is selected (highlighted). These buttons represent the purposes (read modes) of copying, and the meanings of these buttons will be described in detail later.

The cancel button 410 cancels a copying operation or a prescan operation. This cancel button 410 is effective only during copying or prescan and grayed out in other cases. When the cancel button 410 is clicked (pressed) during copying or prescan, the copying or prescan is stopped, and the operation returns to a standby state.

FIG. 5 is a view showing reading settings and printing settings meant by the buttons 411 to 416 representing copy purposes. As shown in FIG. 5, reading settings and printing settings are set for each copy purpose. That is, a reading method and reading resolution as reading settings are set for the scanner printer 102 equipped with the scanner cartridge 105 via the scanner driver 303. Also, a printing method, printing resolution, printing media, and printing quality as printing settings are set for the scanner printer 102 equipped with the ink cartridge 104 via the printer driver 304. "Printing quality" is related to the printing operation of the scanner printer 102. For example, the ink discharge amount from the ink cartridge 104, the number of passes (the number of times of scan in one region on the paper surface), and the like are set.

As an example, when the prescan button 409 is clicked while the photograph button 413 is chosen, the reading method "color" and reading resolution "360×360 dpi" are set as reading settings for the scanner printer 102, and the printing method "color", printing resolution "360×360 dpi", printing medium "high-quality paper", and printing quality "high quality" are set as printing settings for the scanner printer 102.

When the prescan button 409 is clicked while the photograph button 413 is chosen, the reading method "color" and reading resolution "90×90 dpi" are set as reading settings for the scanner printer 102, and no printing setting is performed for the scanner printer 102. In this prescan, not "360×360 dpi" shown in FIG. 5 but "90×90 dpi" is set as the reading resolution because the reading resolution is set to "90×90 dpi" for all copy purposes in prescan in order to increase the reading rate. Also, nothing is set for the scanner printer 102 because no printing operation is performed in prescan, so it is unnecessary to perform settings concerning printing. That is, in this embodiment, a reading method is the only value that is made effective when the prescan button 409 is clicked.

As described above, the settings shown in FIG. 5 represent the set values of reading settings and printing settings preset in the buttons 411 to 416. Also, an operator can select copy modes corresponding to copy purposes by using the buttons 411 to 416. The set values shown in FIG. 5 correspond to the individual copy modes. These set values are stored in a memory as information assigned to these buttons (copy modes) 411 to 416 in the form of a table (database).

When the copy button 408 or prescan button 409 is clicked (pressed), the UI manager 302 acquires pieces of information stored in the memory, i.e., information assigned to the selected (highlighted) button (one of the buttons 411 to 416), information of the original size selected by the original size selector 404, information of the paper size (printing paper size) selected by the printing paper size selector 405, and reading resolution information (90×90 dpi) for prescan, and notifies the scanner driver 303 and the printer driver 304 of these pieces of information. In accordance with these pieces of information transferred from the UI manager 302, the scanner driver 303 and the printer driver 304 control the scanner printer 102.

The designation of a printing medium shown in FIG. 5 represents that image processing optimum for a designated medium is performed, and is based on the assumption that the designated medium is set by the user.

Also, in the column of reading method, "color" means that an image is read by multiple values of R (red), G (green), and B (blue), "gray scale" means that an image is read by multiple values of black and white, and "black-and-white" means that an image is read by two values, i.e., black and white. In the column of printing method, "color" means that an image is printed by multiple values of C (cyan), M (magenta), Y (yellow), and K (black), "gray scale" means that an image is printed by multiple values of black, and "monochromatic" means that an image is printed by two values of black.

The processing of the copy application (UI manager 302) according to this embodiment will be described below with reference to FIGS. 6 to 8.

Figure 6:
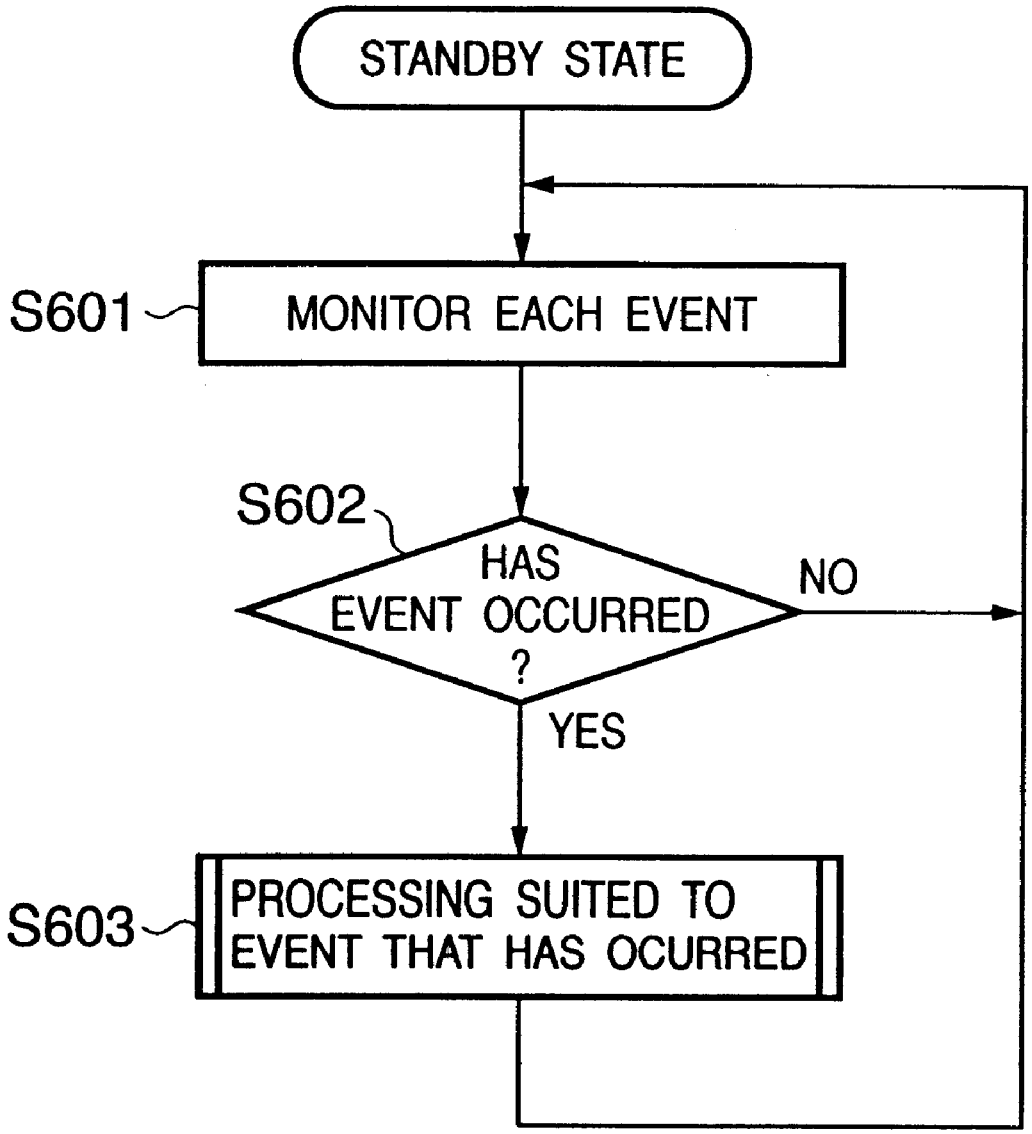
FIG. 6 is a flow chart showing processing in standby state performed by a copy application 301.

FIG. 6 is a flow chart showing standby-state processing by the copy application 301. In step S601, the UI manager 302 monitors the occurrence of each event in standby state. If in step S602 an event such as clicking (pressing) of the copy button 408 occurs, the flow advances to step S603, and the UI manager 302 performs processing suited to the event. The flow then returns to step S601.

Figure 7:
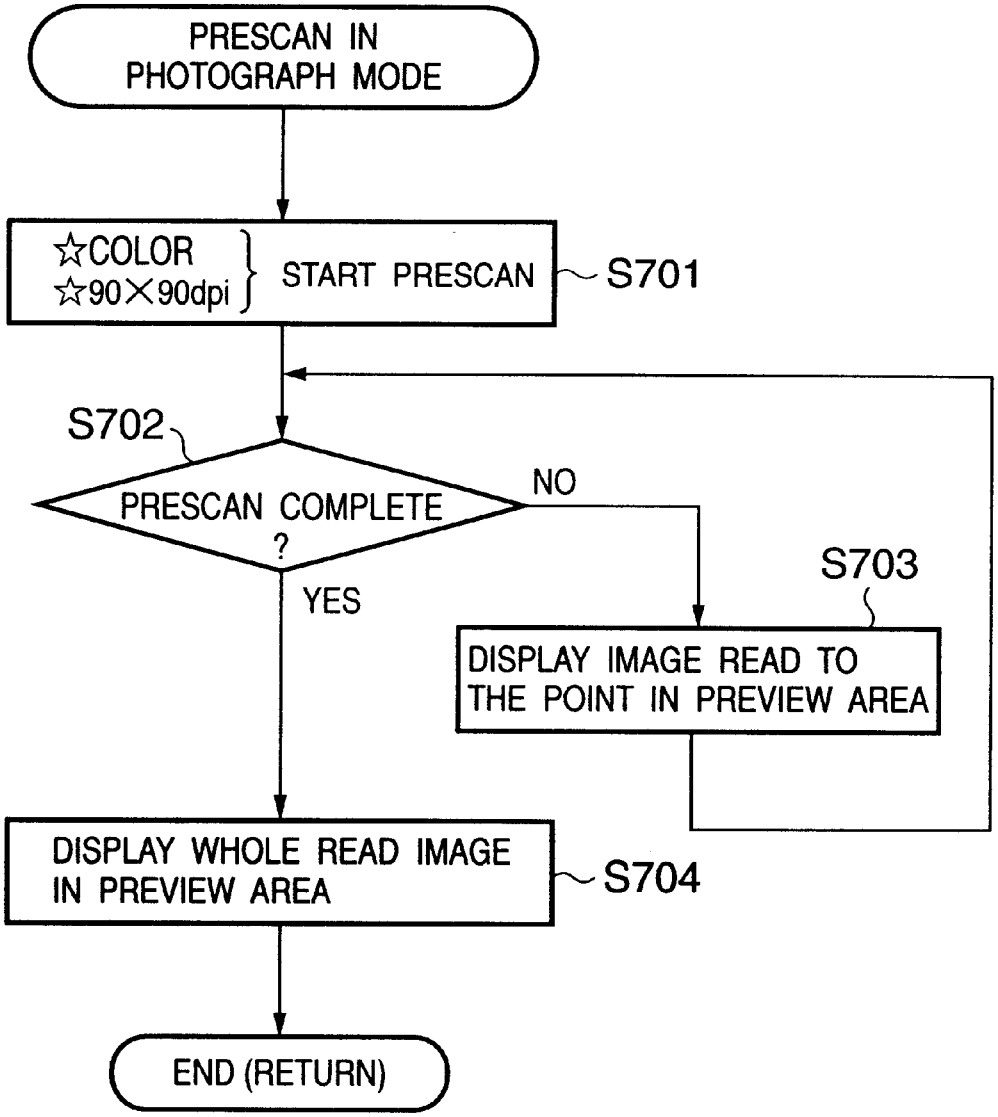
FIG. 7 is a flow chart showing event processing in step S603 of FIG. 6.

FIG. 7 is a flow chart showing the event processing in step S603 shown in FIG. 6. This flow chart represents processing (prescan in photograph mode) when the prescan button 409 is clicked (pressed) while the photograph button 413 is selected (highlighted). Assume that a color photograph is prepared as an original.

To prescan in photograph mode, in step S701 the UI manager 302 starts prescan by setting the reading method "color" and the reading resolution "90×90 dpi" shown in FIG. 5 for the scanner printer 102. In step S702, the UI manager 302 checks whether the prescan is complete. If NO in step S702, the flow advances to step S703, and the UI manager 302 displays at any time an image read to the point in the preview area 402. If the prescan is completed after that, the flow advances to step S704, and the UI manager 302 displays the whole read image in the preview area 402, and terminates this event processing.

FIG. 8 is a flow chart showing the event processing in step S603 shown in FIG. 6. This flow chart represents processing (copy in photograph mode) when the copy button 408 is clicked (pressed) while the photograph button 413 is selected (highlighted). Assume that a color photograph is prepared as an original.

To copy in photograph mode, in step S801 the UI manager 302 sets the copy magnification from the original size selected by the original size selector 404 and the printing paper size selected by the printing paper size selector 405. More specifically, this magnification is 100% since both the original size and printing paper size are A4 (210×297 mm) in the example shown in FIG. 4. In step S802, the UI manager 302 starts copy reading by setting the reading method "color" and the reading resolution "360×360 dpi" as shown in FIG. 5 for the scanner printer 102.

Figure 9:
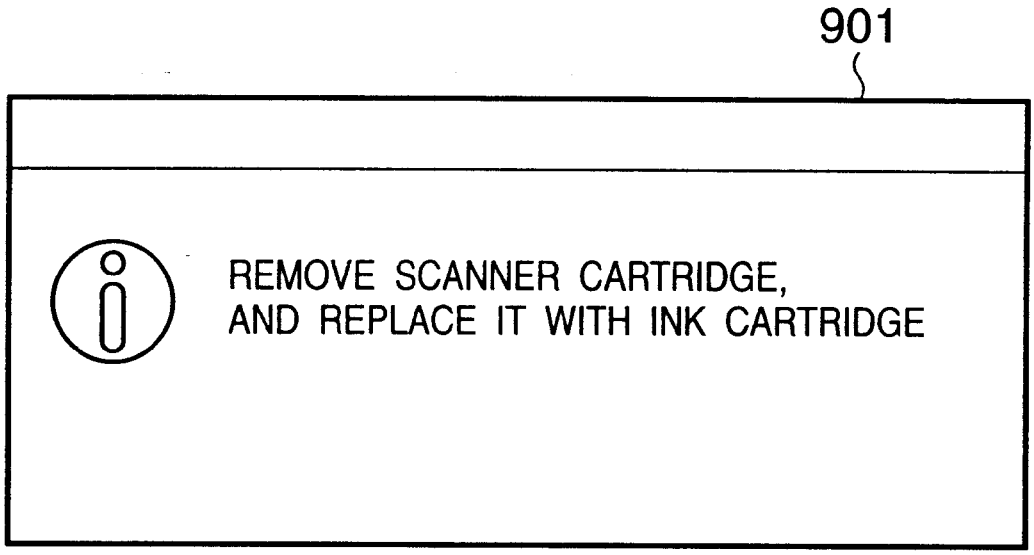
FIG. 9 is a view showing displayed contents of a cartridge exchange message box.

In step S803, the UI manager 302 checks whether the copy reading is complete. If NO in step S803, the flow advances to step S804, and the UI manager 302 displays at any time an image read to the point in the preview area 402. If the copy reading is completed, the flow advances to step S805, and the UI manager 302 displays the whole read image in the preview area 402. In step S806, the UI manager 302 displays a cartridge exchange message box 901 as shown in FIG. 9. In step S807, the UI manager 302 sends to the scanner printer 102 a control command for causing the scanner printer 102 to return information concerning the cartridge mounted on the carriage 103, and receives a response to the command. In step S808, the UI manager 302 confirms the information of the cartridge mounted on the scanner printer 102.

If the ink cartridge 104 is not mounted (if the cartridge information is b) or c)), the flow advances to step S812 to wait for 5 sec. After that, the flow returns to step S807, and the UI manager 302 repeats the cartridge information receiving process described above. If the scanner cartridge 105 is removed and the ink cartridge 104 is mounted (if the cartridge information is a)), the flow advances to step S809, and the UI manager 302 closes the cartridge exchange message box and starts printing in the subsequent processing. That is, if the scanner cartridge 105 is replaced with the ink cartridge 104 by the processing from step S807 to step S809 after reading is performed by the scanner cartridge 105, this replacement is monitored and a printing operation is started. By this processing, when the ink cartridge 104 for printing is attached to the apparatus after reading is performed, a printing operation can be automatically started.

In step S810, the UI manager 302 starts copy printing by setting the printing method "color", printing resolution "360×360 dpi", printing medium "high-quality paper", and printing quality "high quality" as shown in FIG. 5 for the scanner printer 102. The UI manager 302 repeats this copy printing until copy printing of the number of copies designated by the copy quantity designating portion 407 is completed (step S811). When the copy printing is complete, the UI manager 302 terminates this event processing.

Figure 10:
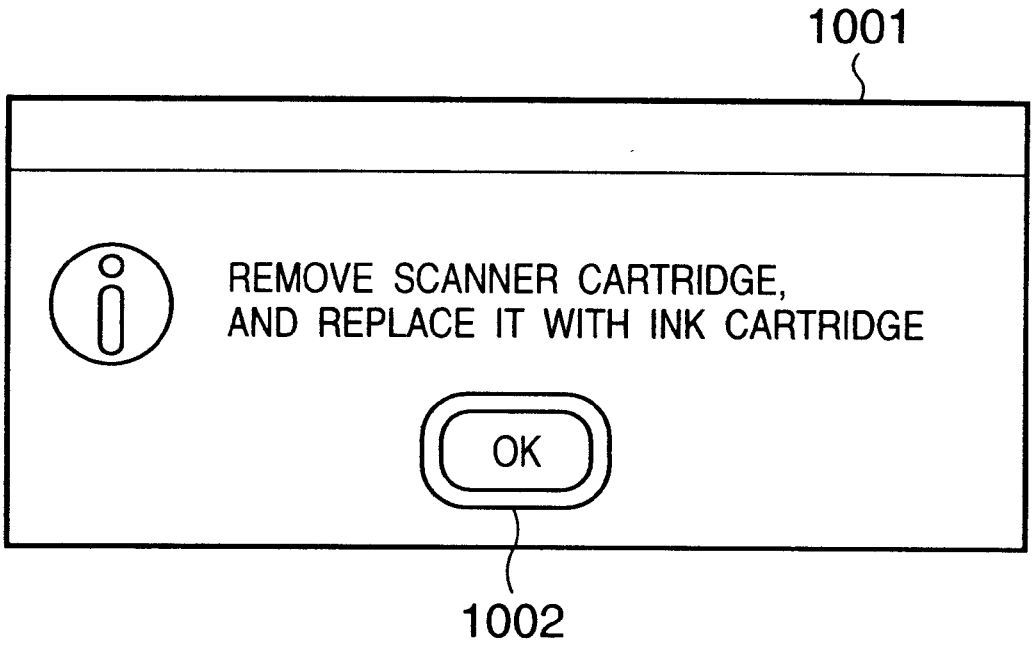
FIG. 10 is a view showing displayed contents of a conventional cartridge exchange message box.

Although the copy operation is described above, the operation is not restricted to copying. That is, when the scanner cartridge 105 is replaced with the ink cartridge 104 or vice versa, the cartridge mounted on the carriage 103 of the scanner printer 102 is automatically detected. This eliminates the need for the conventional OK button (1002 shown in FIG. 10) in the cartridge exchange message box and also obviates clicking of the button. Accordingly, the user can readily perform copying with a simple operation.

For example, when a plurality of originals are to be successively copied, a cartridge exchange message box such as "remove ink cartridge and replace it with scanner cartridge" is displayed after copying of the first original is completed and before reading of the second original is started. In this case, the cartridge mounted on the carriage 103 of the scanner printer 102 is automatically detected as described above. Since this eliminates the need for the conventional OK button in the cartridge exchange message box and also obviates the need for clicking of the button, the user can readily copy with a simple operation.

In this embodiment, Microsoft Windows 95 or 98 is used as the OS. However, the present invention can be achieved with any arbitrary OS by the use of the above arrangement.

Also, in this embodiment a parallel interface based on the IEEE P1284 as a standard of Standard Signaling Method for a Bi-directional Parallel Peripheral Interface for Personal Computers is used as the interface between the PC 101 and the scanner printer 102. However, the present invention can be realized with any arbitrary interface by the use of the above arrangement.

As has been described above, this embodiment comprises a scanner capable of reading an original, a printer capable of printing image data, and a host computer communicably connected to the scanner and the printer. An application including a scanner driver for controlling the scanner and a printer driver for controlling the printer is installed in the host computer. This application has a copy function of copying an original set on the scanner and printing the copied original by the printer, and includes a copy start button as a user interface. If this copy start button is pressed when a reading head is attached to this scanner printer apparatus, original reading is started. When this reading operation is complete, a printhead is attached to start a printing operation.

This arrangement achieves the following effects:

(1) No conventional OK button is necessary in a head exchange message displayed in head exchange after a reading operation. Therefore, the user need not click the OK button.

(2) Item (1) above allows the user to easily copy by a simple operation.

The present invention can be applied to a system constituted by a plurality of devices (e.g., a host computer, interface, reader, and printer) or to an apparatus (e.g., a copying machine or facsimile apparatus) comprising a single device.

Further, the object of the present invention can also be achieved by supplying a storage medium storing program codes of software for implementing the function of the above embodiment to a system or an apparatus, and reading out and executing the program codes stored in the storage medium by a computer (or a CPU or MPU) of the system or apparatus.

In this case, the program codes read out from the storage medium implement the function of the above embodiment, and the storage medium storing these program codes constitutes the invention.

As this storage medium for supplying the program codes, it is possible to use, e.g., a floppy disk, hard disk, optical disk, magnetooptical disk, CD-ROM, CD-R, magnetic tape, nonvolatile memory card, and ROM.

Furthermore, besides the function of the above embodiment being implemented by executing the read program codes by the computer, the present invention includes a case where an OS (Operating System) or the like running on the computer performs a part or the whole of actual processing in accordance with designations by the program codes and thereby implements the function of the above embodiment.

Furthermore, the present invention also includes a case where, after the program codes read out from the storage medium are written in a memory of a function extension board inserted into the computer or of a function extension unit connected to the computer, a CPU or the like of the function extension board or function extension unit performs a part or the whole of actual processing in accordance with designations by the program codes and thereby implements the function of the above embodiment.

In the embodiment as has been described above, attachment of a predetermined head can be confirmed without any cumbersome operation by a user. This can improve the convenience for the user.

As many apparently widely different embodiments of the present invention can be made without departing from the spirit and scope thereof, it is to be understood that the invention is not limited to the specific embodiments thereof except as defined in the claims.

What is claimed is:

1. An image printing system which comprises an apparatus having an attaching unit for interchangeably attaching one of a printhead for printing and a reading head for reading, and an information processor connected to said apparatus, and which can print a read image, comprising:

detecting means for detecting the type of head attached to said apparatus; and checking means for checking the type of head detected by said detecting means, wherein said information processor starts a predetermined operation after confirming that said reading head is attached, when starting image reading, and that said printhead is attached, when starting image printing, on the basis of the type of head, and wherein said information processor starts a printing operation for a read image by said printhead when confirmed that said printhead has been attached after the reading operation by said reading head.

2. The system according to claim 1, wherein said detecting means detects whether the attached head is said printhead or said reading head on the basis of an ID stored in the head.

3. The system according to claim 1, wherein said checking means checks the type of the detected head when said information processor transmits a predetermined command to said apparatus and said apparatus notifies with information indicating the attached state of the head.

4. The system according to claim 3, wherein said checking means displays a head exchange message indicating exchange of heads, until a predetermined head is attached, on the basis of the information indicating the attached state of the head.

5. The system according to claim 3, wherein said checking means erases the head exchange message when confirming that a predetermined head is attached, on the basis of the information indicating the attached state of the head.

6. The system according to claim 1, wherein said apparatus is an image forming apparatus for forming an image with said printhead attached to said attaching unit.

7. The system according to claim 1, further comprising control means for starting a printing operation by said printhead when determining that said reading head is replaced with said printhead, on the basis of the detection result from said detecting means, after said reading head is attached to read an image.

8. The system according to claim 1, wherein said printhead is an inkjet printhead for printing data by discharging ink.

9. The system according to claim 8, wherein said printhead is an ink cartridge integrated with an ink tank for containing ink.

10. A printing method of an image printing system which comprises an apparatus having an attaching unit for interchangeably attaching one of a printhead for printing and a reading head for reading, and an information processor connected to said apparatus, and which can print a read image, comprising:

a detecting step of detecting the type of head attached to said apparatus; and a checking step of checking the type of head detected in the detecting step, wherein said information processor starts a predetermined operation after confirming that said reading head is attached, when starting image reading, and that said printhead is attached, when starting image printing, on the basis of the type of head, and wherein said information processor starts a printing operation for a read image by said printhead when confirmed that said printhead has been attached after the reading operation by said reading head.

11. The method according to claim 10, wherein the detecting step comprises detecting whether the attached head is said printhead or said reading head on the basis of an ID stored in the head.

12. The method according to claim 10, wherein the checking step comprises checking the type of the detected head when said information processor transmits a predetermined command to said apparatus and said apparatus notifies with information indicating the attached state of the head.

13. The method according to claim 12, wherein the checking step comprises displaying a head exchange message indicating exchange of heads, until a predetermined head is attached, on the basis of the information indicating the attached state of the head.

14. The method according to claim 12, wherein the checking step comprises erasing the head exchange message when confirming that a predetermined head is attached, on the basis of the information indicating the attached state of the head.

15. The method according to claim 10, wherein said information processor starts a printing operation by said printhead when determining that said reading head is replaced with said printhead, on the basis of the detection result in the detecting step, after said reading head is attached to read an image.

16. A computer-readable storage medium storing a program of a printing method of an image printing system which comprises an apparatus having an attaching unit for interchangeably attaching one of a printhead for printing and a reading head for reading, and an information processor connected to said apparatus, and which can print a read image, wherein said program comprises:

a code of the detecting step of detecting the type of head attached to said apparatus;

a code of a checking step of checking the type of head detected in the detecting step; and a code of a control step of said information processor, which starts a predetermined operation after confirming that said reading head is attached, when starting image reading, and that said printhead is attached, when starting image printing, on the basis of the type of head, and wherein said information processor starts a printing operation for a read image by said printhead when confirmed that said printhead has been attached after the reading operation by said reading head.

* * * * *